US005423102A

United States Patent [19]

Madison

[11] Patent Number: 5,423,102

[45] Date of Patent: Jun. 13, 1995

[54] PORTABLE CLEANING DEVICE

[76] Inventor: Ava Madison, 2310 Harding Ave., Muscle Shoals, Ala. 35661

[21] Appl. No.: 293,171

[22] Filed: Aug. 19, 1994

[51] Int. Cl.[6] ..... A46B 13/04

[52] U.S. Cl. ..... 15/22.2; 15/22.1; 15/28; 15/29

[58] Field of Search ..... 15/22.1, 22.2, 22.4, 15/23, 24, 28, 29, 97.1; 51/170 R, 170 TL

[56] References Cited

U.S. PATENT DOCUMENTS

| | | | |
|---|---|---|---|
| 2,526,976 | 10/1950 | Smith | 15/22.1 |
| 2,858,703 | 11/1958 | Willcox | 15/22.1 |
| 3,235,897 | 2/1966 | Fortenberry | 15/24 |
| 3,396,417 | 8/1968 | Starr | 15/29 |
| 3,512,201 | 5/1970 | Taylor | 15/22.1 |
| 3,892,004 | 7/1975 | Downes | 15/24 |
| 3,968,789 | 7/1976 | Simonicini . | |
| 4,048,690 | 9/1977 | Wolfson | 15/29 |
| 4,137,588 | 2/1979 | Sandt et al. . | |
| 4,397,056 | 8/1983 | Miller . | |
| 4,964,398 | 10/1990 | Jones . | |
| 5,208,933 | 5/1993 | Lustig et al. . | |

FOREIGN PATENT DOCUMENTS

| | | |
|---|---|---|
| 3025293A1 | 1/1982 | Germany . |
| 1340656 | 12/1973 | United Kingdom . |
| 92/021159 | 2/1992 | WIPO . |

*Primary Examiner*—Edward L. Roberts, Jr.
*Attorney, Agent, or Firm*—Richard C. Litman

[57] ABSTRACT

A portable hand held cleaning device is adapted to receive various cleaning implements, such as bristle brushes, abrasive wheels, chisels, and the like, into a tool engaging member. The tool engaging member is preferably operable by a rechargeable battery to selectively rotate and/or reciprocate at varying speeds. The rechargeable battery is included in a housing. The tool engaging member is preferably displaceable to improve the efficiency of the cleaning device in hard to reach areas. The housing may further include plumbing and a pump for delivering fluid from a cleansing fluid container to a discharge proximate the cleaning tool engaging member.

14 Claims, 3 Drawing Sheets

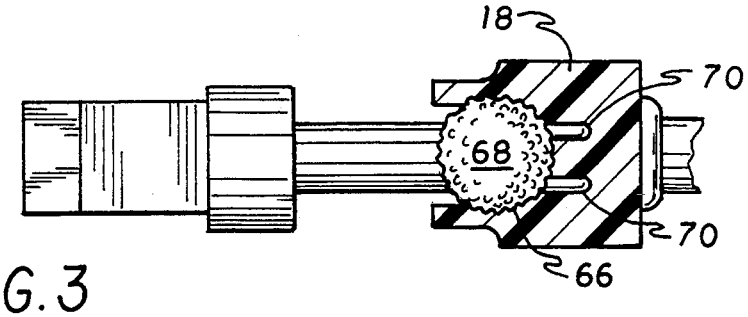
FIG. 3
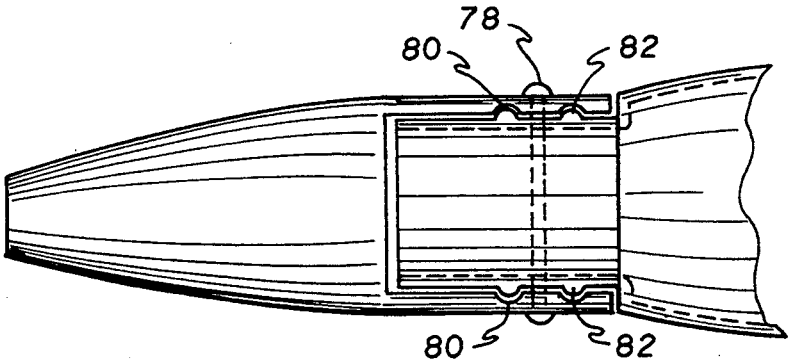
FIG. 4
FIG. 5A
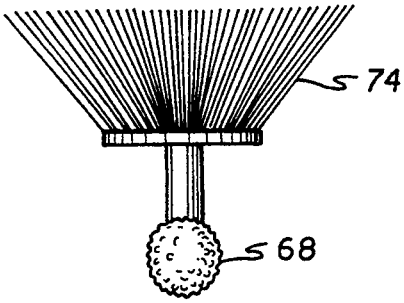
FIG. 5B
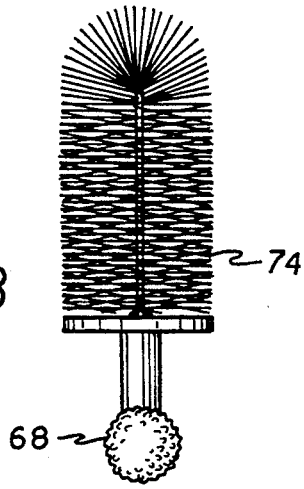
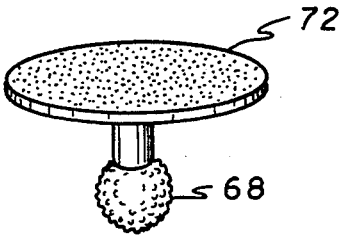
FIG. 5C
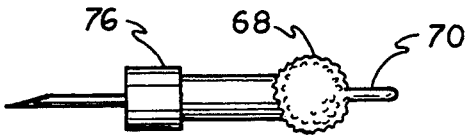
FIG. 5D

PORTABLE CLEANING DEVICE

BACKGROUND OF THE INVENTION 1. FIELD OF THE INVENTION

The present invention relates to a cleaning device and more particularly, to a portable hand held, battery operated rechargeable cleaning device that selectively rotates and reciprocates a tool engaging member.

2. DESCRIPTION OF THE PRIOR ART

The prior art is abound with cleaning devices, both battery operated and cord operated, which continuously rotate cleaning implements. Oscillating and reciprocating mechanisms in portable battery operated cleaning devices, with or without associated charging devices, are well known.

U.S. Pat. No. 3,968,789, issued Jul. 13, 1976 to Giancarlo Simonicini, discloses a hand held cleaning apparatus capable of operating detachable cleaning implements. The cleaning apparatus includes a electrical terminals, a rechargeable battery, and electrical motor, an operating switch, a speed reducing gear train, and a device for providing reciprocating motion of cleaning implement receiving tongues.

U.S. Pat. No. 4,137,588, issued Feb. 6, 1979 to Clayton C. Sandt, discloses a massaging apparatus comprising a casing provided with a handle. Housed within the casing is a motor capable of imparting rotary oscillation motion. A circular brush is removably mounted to the shaft of the motor. On the casing is a bellows-shaped container of liquid. The liquid is conveyed from the container to a dispensing bore provided in the massaging brush.

U.S. Pat. No. 4,397,056, issued Aug. 9, 1983 to Albert J. Miller, discloses a power assisted cleaning device including an elongated stem having a brush at an end thereof and a spray outlet proximate the brush. The brush is joined to a reciprocating rotating shaft extending through the stem to provide agitation to the brush. A pump is connected between a liquid cleanser tank and a tubing extending from the pump to a spray outlet. Rechargeable batteries drive the pump and motor.

U.S. Pat. No. 4,964,398, issued Oct. 23, 1990 to Lethe L. Jones, discloses a shampoo or massage device including a pistol grip handle having a dc motor, a gear reduction unit, a rotary-to-reciprocating conversion unit, and rechargeable batteries therein.

U.S. Pat. No. 5,208,933, issued May 11, 1993 to L. Paul Lustig, discloses a dental tool which dispense liquid dentifrice from a removable and replaceable cartridge by way of a rotary implement and revolving brush implement.

PCT Application No. WO 92/021159, published Feb. 20, 1992, discloses an electrical toothbrush having a housing designed to accommodate a drive motor, switch elements, and an electrical power supply. The drive motor rotates a drive shaft coupled to a brush head.

German Application No. DE 3025293 A1 published Jan. 28, 1982, discloses a toilet cleaning device. The device includes a housing supporting a detachable brush, a motor or a manual crank, and cog belt connecting the brush to the motor or crank.

British Application No. 1 340 656 Dec. 12, 1973, discloses a cordless battery operated polisher comprises a handle for housing batteries, a motor, a switch connected in series with the battery and motor, and a brush reciprocated by the motor.

None of the above inventions and patents, taken either singly or in combination, is seen to describe the instant invention as claimed.

SUMMARY OF THE INVENTION

The present invention relates to a portable hand held cleaning device adapted to receive various cleaning implements, such as bristle brushes, abrasive wheels, chisels, and the like, into a tool engaging member. The tool engaging member is preferably operable by a rechargeable battery to selectively rotate and reciprocate at varying speeds. The battery is included in a housing. The tool engaging member is preferably displaceable to improve the efficiency of the cleaning device in hard to reach areas. The housing may further include plumbing and a pump for delivering fluid from a cleansing fluid container to a discharge proximate the tool engaging member.

Accordingly, it is a principal object of the invention to provide a portable hand held cleaning device operable to selectively rotate and reciprocate at varying speeds.

It is another object that the cleaning device be adapted to receive various cleaning implements into a tool engaging member.

It is a further object that the tool engaging member be operable by a rechargeable battery.

Still another object is that the tool engaging member be selectively rotate and reciprocate at varying speeds.

Another object is that the tool engaging member extend from and be displaceable to improve the efficiency of the cleaning device in hard to reach areas.

It is yet another object that the housing further include plumbing and a pump for delivering fluid from a cleansing fluid container to a discharge proximate the tool engaging member.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a detail of a tool engaging member.

FIG. 4 is a detail of a pivotal connection for adjoining the head of the housing of the cleaning device to the main body of the housing of the cleaning device.

FIGS. 5A through 5D are elevational views of various cleaning implements engageable with the tool engaging member of the cleaning device.

Similar reference characters denote corresponding features consistently throughout the attached drawings.

DETAILED DESCRIPTION OF THE PREFERRED EMBODIMENTS

Figure 1:
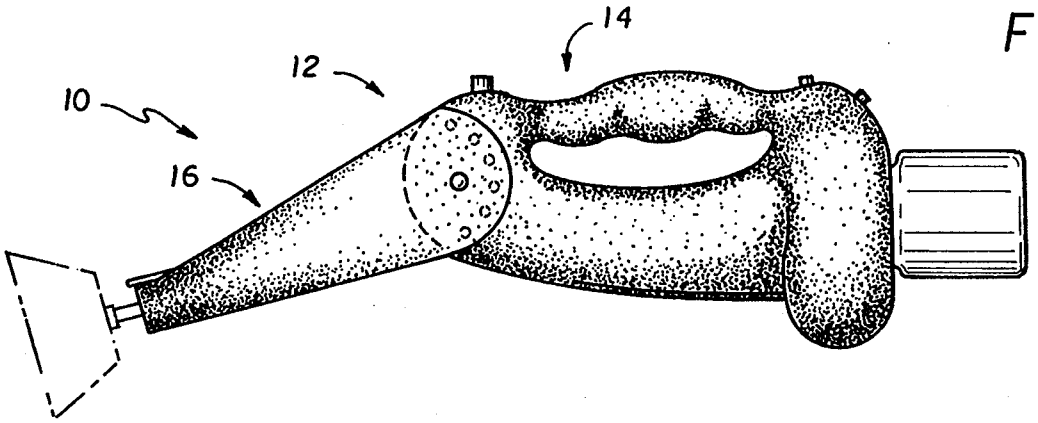
FIG. 1 is a elevational view of a portable rechargeable hand held cleaning device according to the present invention.
Figure 2:
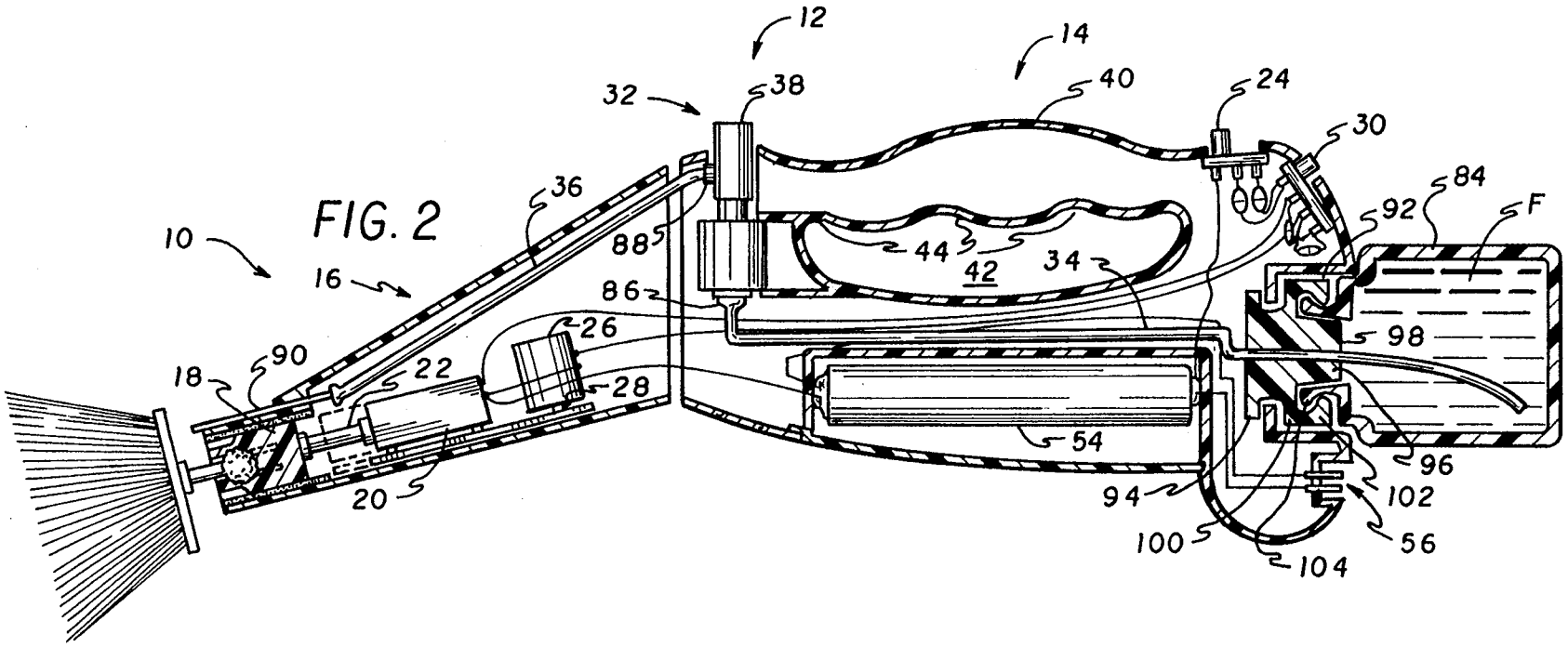
FIG. 2 is a section view of the cleaning device as shown in FIG. 1.

The present invention, as shown in FIG. 1, is a portable rechargeable hand held cleaning device 10 adapted to receive various cleaning implements, such as bristle brushes, abrasive wheels, chisels, and the like (shown in FIGS. 5A through 5B), into a tool engaging member 18 (clearly shown in FIGS. 2 and 3).

Referring to FIG. 2, the device 10 basically comprises a housing 12 comprising a main body 14 and a head 16, a tool engaging member 18, a prime mover 20, a power transmitting element 22, and a control element 24. The control element 24 controls the operation of the prime mover 20. The prime mover 20 provides a rotary motion which is transmitted by the power transmitting element 22 to the tool engaging member 18.

The device 10 may include an additional prime mover 26, power transmitting element 28, and control element 30. The additional control element 30 controls the operation of the additional prime mover 26. The additional prime mover 26 provides a linear oscillating or vibratory motion which is transmitted indirectly by the additional power transmitting element 28 to the tool engaging member 18.

The device 10 may further include a fluid conveying assembly 32. The fluid conveying assembly 32 includes an inlet 34, a discharge 32, and a pump 38 for delivering fluid from the inlet 34 to the discharge 36. A more detailed description of these structural elements and their interrelationship with one another is set forth herebelow.

Referring back to FIG. 1, the ergonomically designed main body 14 facilitates as a handgrip. An outer upper surface 40 of the main body 14 is convex to comfortably conform to the palm of a user's hand. An opening 42 in the main body 14 is provided for the passage of the user's fingers therethrough. An inner upper surface delineating the opening 42 includes a plurality of finger depressions 44 for receiving a user's fingers.

Figure 6:
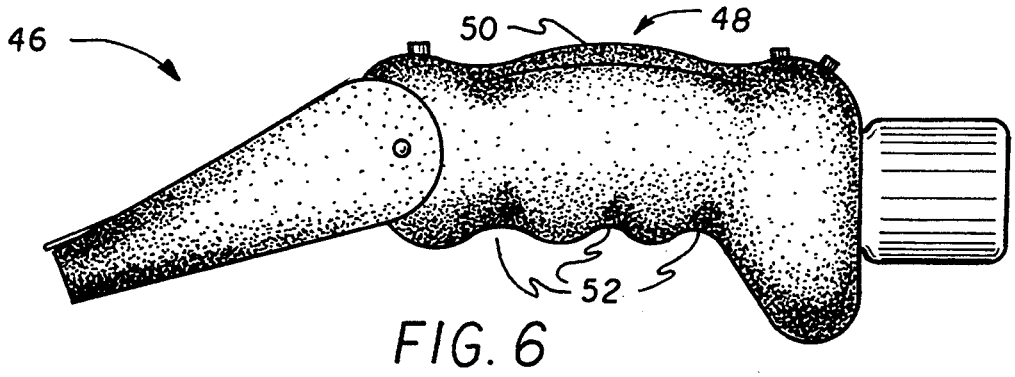
FIG. 6 is an elevational view of an alternative portable rechargeable hand held cleaning device.

In accordance with an alternative hand held cleaning device 46, as shown in FIG. 6, the main body 48 may facilitate as a compact handle having a reduce cross-section. Similar to the main body 48 described above, a convex upper surface 50 comfortably conforms to the palm of a user's. Likewise, a plurality of finger depressions 52 along a bottom surface thereof are provided for receiving a user's fingers.

Referring to FIGS. 1 and 2, the aforementioned control element 24 is located along the upper surface of the main body 14 near the proximal end of the main body 14. In this location, the control element 24 is partially obstructed by the user's hand, providing partial protection against inadvertent control of the control element 24.

With reference to FIGS. 1 and 6, the control element 24 includes a power switch. The power switch may be a single pole switch (not shown) connected in series with a battery 54 and the prime mover 20. The battery 54 is removably insertable into the main body 14. It is preferred that the battery 54 be a rechargeable battery to reduce costs associated with battery replacement. A connector 56, such as that shown in FIG. 2, for connecting the battery 54 to a battery charger (not shown) may be accessible exteriorly of the main body 14.

Figure 7:
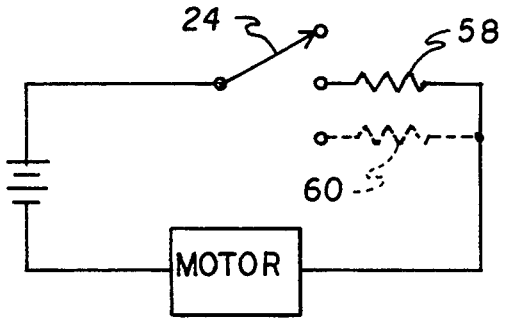
FIG. 7 is an electrical schematic of an electrical circuit for electrically operating the tool engaging member.

Alternatively, the control element 24 may include a double pole switch, as is clearly shown in FIG. 7. Sufficient wiring is provided for connecting the double pole switch 24 in series with two parallel branch resistor elements 58, 60, the battery 54, and the prime mover 20 to form a series circuit. One of the resistor elements 58 is a high resistance element and the other resistor element 60 is a comparatively low resistance element.

The double pole switch 24 selectively opens the circuit, controls current flow through the high resistance element 58 to operate the prime mover 20 at a low speed, and controls current flow through the low resistance element 60 to operate the prime mover 20 at a comparatively high speed.

Figure 8:
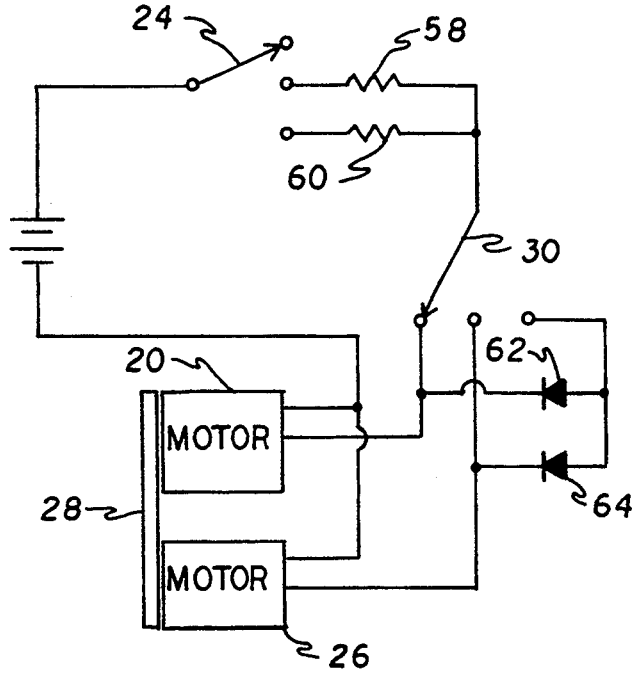
FIG. 8 is an electrical schematic of an alterative electrical circuit for electrically operating the tool engaging member.

The additional control element 30 may be located along the upper outer surface 40 of the main body 14 adjacent the distal end of the main body 14. As shown in FIG. 8, this additional control element 30 is a triple pole switch. Sufficient wiring is provided for connecting the double pole switch 24 and the two parallel branch resistor elements 58, 60 in series with the triple pole switch 30, the battery 54, and the prime movers 20, 26 to form an alternative series circuit.

A description of the parallel branch resistor elements 58, 60 and function thereof is provided above. The triple pole switch 30 and the prime movers 20, 26 are described herebelow. A first pole of the triple pole switch 30 is connected in series with the first prime mover 20, forming a first branch. A second pole is connected in series with the additional or second prime mover 26, forming a second branch. A third pole is connected to the first branch with a first diode 62 and further connected to the second branch with a second diode 64.

The first and second branches are parallel relative to one another. The diodes 62, 64 block current flow from the first branch to the second branch and vice versa yet permit current to flow from third pole to both the first and second branches.

The triple pole switch 30 selectively controls current flow through the first branch to operate the first prime mover 20, and through the second branch to operate the additional or second prime mover 26, or through both branches to simultaneously operate both prime movers 20, 26.

The tool engaging member 18 may be rotary driven at varying speeds by at least the first prime mover 20. Alternatively, the tool engaging member 18 may further be linearly vibrated by the second prime mover 26. As shown in the drawings, the tool engaging member 18 is axially fixed relative to the first prime mover 20. The first prime mover 20, in turn, may be axially oscillated by the second prime mover 26.

As mentioned above, the first prime mover 20, the second prime mover 26, or both may be selectively driven to rotate the tool engaging member 18, oscillate the tool engaging member 18, or both rotate and oscillate the tool engaging member 18 of the cleaning device 10 simultaneously.

The tool engaging member 18 is rotationally and axially displaceable relative to the head 16 of the cleaning device 10. The tool engaging member 18 is configured to received a cleaning implement. As shown in FIG. 3, the head 16 includes a socket 66 for matingly receiving a ball 68 depending from the cleaning implement. The socket 66 and the ball 68 are provided with frictionally engageable surfaces, such as the interengageable nubs protruding from the ball 68 and socket 66 surfaces. These nubs interengage to resist slippage between the ball 68 and socket 66.

The rear of the socket 66 may include a key aperture (not shown) or at least two space apertures 70, and the rear of the ball 68 may correspondingly include a key (not shown) or at least two spaced prongs 70 protruding therefrom. The prongs 70 are arranged and configured to be matingly engageable with the apertures 70 to prevent the cleaning implement from rotating relative to the tool engaging member 18.

A plurality of cleaning implements, such as those shown in FIGS. 5A through 5D, may be employed with the cleaning device 10. Cleaning implements may include, but are not limited to, disks 72 for polishing, scrubbing and scouring, and abrading, brushes 74 having axially and radially extending bristles, and chisels 76.

The tool engaging member 18 and the first and second prime movers 20, 26 are shown to be accommodated by the head 16. The head 16 may be rigidly affixed to the main body 14, however, it is preferable that the head 16 be movably attached to the main body 14. In this way, the head 16 may be displaced as desired to aid in cleaning hard to reach areas.

The displacement of the head 16 relative to the main body 14 may be accomplished in the following manner. As shown in FIG. 4, the head 16 is pivotally attached to the main body 14, such as with a pivot pin 78. The pivot pin 78 shown is mutually engageable with the head 16 and the main body 14.

To retain the head 16 in a substantially fixed position relative to the main body 14, the head 16 may frictionally cooperate with the main body 14. As shown in the drawings, the head 16 may be provided with a series of recesses or dimples 80 and the main body 14 may be provided with one or more protrusions 82 and vice versa. Upon displacing the head 16 relative to the main body 14, the protrusion or protrusions 82 will frictionally engage and disengage one or more of the recesses 80. When the head 16 is set in a desired location, the protrusion or protrusions 82 will frictionally engage one or more of the recesses 80, retaining the head 16 in a substantially fixed position.

The main body 14 may further include plumbing 34, 36 and a pump 38 for delivering fluid from a cleansing fluid container 84 to a discharge proximate the tool engaging member 18. An example of such as configuration appears in FIG. 2. A manual pump 38 is located along the upper surface 40 of the main body 14 near the distal end of the main body 14. In this location, the pump 38 is readily accessible with the user's thumb.

Sufficient inlet plumbing 34 is provided for delivering cleansing fluid F from the cleansing fluid container 84 to the pump inlet 86. Further, sufficient discharge plumbing 36 is provided for delivering cleansing fluid F from the pump outlet 88 to a discharge nozzle 90 disposed at a distal end to the head 16 proximate the tool engaging member 18. By repeatedly depressing the pump 38, fluid F is delivered from the cleansing fluid container 84 to the nozzle 90.

The fluid container 84 may be in the form of a cartridge, which sealing engages the main body 14 and fluidly communicates with the inlet plumbing 34. As shown in the drawings, the proximal end of the main body 14 is provided with a recess 92. A seal 94 is fixedly located in the recess 92. The seal 94 has a resilient plug 96 which fits substantially fluid tight in the mouth 98 of a cartridge 84. An aperture 100 passes through the plug 96. The aperture 100 provides passage through which fluid is permitted to be communicated to pump 38 via the inlet plumbing 34. A resilient annular flange 102 is spaced about the plug 96 which may be engageable with the cartridge 84 as described herebelow.

The cartridge 84 includes a complementary annular flange 104 which is received in the space provided between the seal's annular flange 102 and plug 96 as the plug 96 sealing engages the mouth 98 of the cartridge 84. The inlet plumbing 34 extends into the cartridge 84. As the pump 38 is actuated, the inlet plumbing 34 draws fluid F from the cartridge 84 and delivers that fluid F through the pump 38 and further, through the discharge plumbing 36 and nozzle 90.

It is to be understood that the present invention is not limited to the embodiments described above, but encompasses any and all embodiments within the scope of the following claims.

I claim:

1. A cleaning device comprising:

a housing defining a hollow interior;

a tool engaging member operably disposed within said housing;

a first prime mover disposed within said housing, said first prime mover being configured to produce a rotary motion;

a first power transmitting element disposed within said housing and connected to said first prime mover, said first prime mover being operably connected to said tool engaging member;

a second prime mover disposed within said housing, said second prime mover for configured to produce a reciprocating motion;

a second power transmitting element disposed within said housing to said second prime mover, said second power transmitting element operably connected to said tool engaging member; and a control element and circuitry for variably controlling speed of said first and second prime movers;

2. The device according to claim 1, wherein said housing includes a main body and a head, said head being movably attached to said main body, said tool engaging member being operably disposed within said head.

3. The device according to claim 2, wherein said head is pivotally attached to said main body, said head further frictionally engaging said main body.

4. The device according to claim 1, further including a fluid conveying assembly, said fluid conveying assembly being supported by said housing.

5. The device according to claim 4, wherein said fluid conveying assembly includes:

a pump having an inlet and an outlet, said pump being supported by said housing;

a first fluid conveying tube connected to said pump inlet; and a second fluid conveying tube connected to said pump outlet.

6. The device according to claim 5, wherein said pump is a manually actuated pump.

7. The device according to claim 5, further including a fluid source container, said fluid source container being sealingly and releasably engageable with said housing, said first fluid conveying tube being connectable to a fluid source container.

8. The device according to claim 5, wherein said fluid conveying assembly further includes a discharge disposed adjacent said tool engaging member, said second fluid conveying tube further being connected to said discharge.

9. The device according to claim 1, wherein said control element and circuitry further connect said control element to a power source and to said first and second prime movers.

10. The device according to claim 1, wherein said control element and circuitry further selectively operate said first prime mover independently of said second prime mover, said second prime mover independently of said first prime mover, and both said first and second prime movers simultaneously.

11. A cleaning device comprising:

a housing defining a hollow interior;

a tool engaging member operably disposed within said housing;

a first prime mover disposed within said housing, said first prime mover being configured to produce a rotary motion;

a first power transmitting element disposed within said housing and connected to said first prime mover, said first prime mover being operably connected to said tool engaging member;

a second prime mover disposed within said housing, said second prime mover for configured to produce a reciprocating motion; and a second power transmitting element disposed within said housing and connected to said second prime mover, said second power transmitting element operably connected to said tool engaging member;

said housing including a main body and a head, said head being movably attached to said main body, said tool engaging member being operably disposed within said head, said head being pivotally attached to said main body, said head further frictionally engaging said main body;

a control element and circuitry for connecting said control element to a power source and to said first and second prime movers and for variably controlling speed of said first and second prime movers.

12. The device according to claim 11, further including a fluid conveying assembly, said fluid conveying assembly being supported by said housing, said fluid conveying assembly including:

a pump having an inlet and an outlet, said pump being supported by said housing;

a first fluid conveying tube connected to said pump inlet; and a second fluid conveying tube connected to said pump outlet.

a fluid source container, said fluid source container being sealingly and releasably engagable with said housing, said first fluid conveying tube being connectable to a fluid source container;

said fluid conveying assembly further including a discharge disposed adjacent said tool engaging member, said second fluid conveying tube further being connected to said discharge.

13. The device according to claim 12, wherein said pump is a manually actuated pump.

14. The device according to claim 11, further including a control element and circuitry for selectively operating said first prime mover independently of said second prime mover, said second prime mover independently of said first prime mover, and both said first and second prime movers simultaneously.

* * * * *